US008921242B2

(12) United States Patent
Pesta

(10) Patent No.: US 8,921,242 B2
(45) Date of Patent: Dec. 30, 2014

(54) POLYPROPYLENE LAMINATE SOLID SAFETY POOL COVER WITH RECYCLABILITY

(75) Inventor: LeeAnn Pesta, East Islip, NY (US)

(73) Assignee: Pool Cover Corporation, Hauppauge, NY (US)

( * ) Notice: Subject to any disclaimer, the term of this patent is extended or adjusted under 35 U.S.C. 154(b) by 749 days.

(21) Appl. No.: 12/803,206

(22) Filed: Jun. 22, 2010

(65) Prior Publication Data

US 2011/0308002 A1 Dec. 22, 2011

(51) Int. Cl.

| | |
|---|---|
| ***B32B 27/02*** | (2006.01) |
| ***B32B 27/12*** | (2006.01) |
| ***B32B 27/32*** | (2006.01) |
| ***E04H 4/00*** | (2006.01) |
| ***E04H 4/10*** | (2006.01) |

(52) U.S. Cl.

CPC ..... *E04H 4/10* (2013.01)
USPC ..... 442/43; 442/46; 442/170; 442/171; 442/290; 442/398; 4/498; 4/503

(58) Field of Classification Search

USPC ..... 4/498, 503; 442/170, 171, 290, 398, 43, 442/46; 156/66

See application file for complete search history.

(56) References Cited

U.S. PATENT DOCUMENTS

| | | | | |
|---|---|---|---|---|
| 4,483,127 | A * | 11/1984 | Forkner | 53/580 |
| 4,628,549 | A | 12/1986 | Lazar | |
| 4,698,109 | A | 10/1987 | Lazar | |
| 4,972,529 | A | 11/1990 | Wolfson, Jr. | |
| 4,982,457 | A | 1/1991 | Donaton | |
| 5,096,950 | A | 3/1992 | Galbo | |
| 5,511,536 | A | 4/1996 | Bussey | |
| 5,713,087 | A * | 2/1998 | Maggion et al. | 4/498 |
| 5,843,554 | A | 12/1998 | Katz | |
| 5,860,413 | A * | 1/1999 | Bussey et al. | 4/498 |
| 6,508,247 | B1 | 1/2003 | Karales | |
| 6,571,789 | B1 | 6/2003 | Mora | |
| 6,836,907 | B1 | 1/2005 | Pesta | |
| 6,851,903 | B1 * | 2/2005 | Foggy | 410/118 |
| 2003/0064647 | A1 * | 4/2003 | Chang | 442/290 |
| 2004/0166752 | A1 * | 8/2004 | Taghavi | 442/170 |

OTHER PUBLICATIONS

"Dioxin", 1 page website, Jun. 16, 2010, dictionary.com.
Polyvinyl Chloride, 9 page article, Jun. 16, 2010,wikipedia.org.
"The Poison Plastic", 5 page website, Jun. 16, 2010, chej.org.
"PVC and Fire", 4 page website, Jun. 16, 2010, pvcinformation.org.
Dr. P. A. Bertazzi, "The Seveso Studies on Early and Long-Term Effects of Dioxin Exposure: A Review", 11 page article, Jun. 16, 2010, niehs.nih.gov.
"Endocrine Disruptors",4 page Brochure, May 2010, National Institute of Environmental Health Science.

* cited by examiner

*Primary Examiner* — Jeremy R Pierce
(74) *Attorney, Agent, or Firm* — Alfred M. Walker

(57) ABSTRACT

A light weight, durable, easily recyclable pool cover includes a fabric covering with reinforcing and attachment straps wherein, the reinforcing and attachment straps are attached to said fabric in a criss-crossed pattern. The fabric covering and the straps are produced from a single polymer consisting of polypropylene. The pool cover is entirely recyclable at end of service life by chopping the pool cover components in a simple machine producing granules useful for injection molding of polypropylene products. The pool cover fabric is produced by subjecting three layers of polypropylene sheet material to heat and pressure forming a strong durable fabric wherein the top layer and bottom layer are a solid fabric and the middle layer is multi-filament mesh of polypropylene threads.

4 Claims, 2 Drawing Sheets

POLYPROPYLENE LAMINATE SOLID SAFETY POOL COVER WITH RECYCLABILITY

FIELD OF THE INVENTION

The present invention relates to a durable, plasticizer-free recyclable swimming pool cover.

BACKGROUND OF THE INVENTION

Many swimming pool covers currently on the market include polyvinyl chloride (PVC). Environmentally harmful plasticizers, such as dioxin, are produced when PVC is incinerated and plasticizers may also leach into the swimming pool water when PVC is used as a swimming pool cover. PVC-containing swimming pool covers generally include plasticizers that become brittle and leach into the water due to sun damage resulting in loss of strength of the swimming pool cover. Currently, it is not technically or economically feasible to recycle PVC-reinforced pool cover materials.

A product life cycle starts with a design phase where the functional specifications are defined as well as the cost constraints. Materials are shipped to the factory which manufactures the product. Marketing and promotion create a demand for the product which then translates into sales for a successful product. The product is then purchased by a customer to whom a finished product is then shipped or is picked up by the buyer. What follows is hopefully a long satisfying service life. After a service period, the pool cover is usually replaced. The final part of the product life-cycle is concerned with discarding or recycling of the product after it has served its service life. A swimming pool cover is considerably large in size and heavy in weight.

Swimming pool covers can generally be categorized into one of two types: mesh pool covers and solid laminate pool covers. While mesh pool covers including recyclable polypropylene are known, the open weave structure of the mesh pool covers allows sunlight to get through and promotes the growth of algae in swimming pool water. What is lacking is a swimming pool cover, which combines the lightweight feature of the mesh pool cover, while it is 100% recyclable but which, unlike conventional mesh pool covers, has minimal maintenance by the fact that it reduces algae growth caused by sunlight penetration through a typical mesh swimming pool cover. Polypropylene is a 100 percent recyclable material. However, if part of a pool cover is made of polypropylene and part is made of a different material, such as a copolymer including PVC, the polypropylene bonds to the other material and cannot be extracted for recycling. While polypropylene does not emit contaminants such as plasticizers when burnt, it cannot be recycled if bonded to other plasticizer-containing products.

Additionally maintenance costs are associated with PVC-containing swimming pool covers in that they are known to become depressed by puddles of water. This permanent depression of solid laminate PVC covers adds to the maintenance costs in that water must be continuously pumped from the swimming pool cover or expensive drains are installed. The installed drains may further increase maintenance costs should they become clogged.

SUMMARY OF THE INVENTION

The present invention is directed to a swimming pool cover formed from a fabric covering and reinforcing and attachment straps. The fabric covering is a polypropylene coated fabric of polypropylene multi-filament fiber. The reinforcing and attachment straps are also polypropylene. The reinforcing and attachment straps are connected to the fabric covering in a criss-crossed pattern. The fabric covering and reinforcing and attachment straps are produced only from polypropylene such that the pool cover is plasticizer-free and does not emit any dioxins when burned. In a preferred embodiment, the fabric includes a polypropylene multi-filament fiber sandwiched between a top layer of polypropylene and a bottom layer of polypropylene. Because the various components of the pool cover are formed only from polypropylene, the pool cover is easily recyclable.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
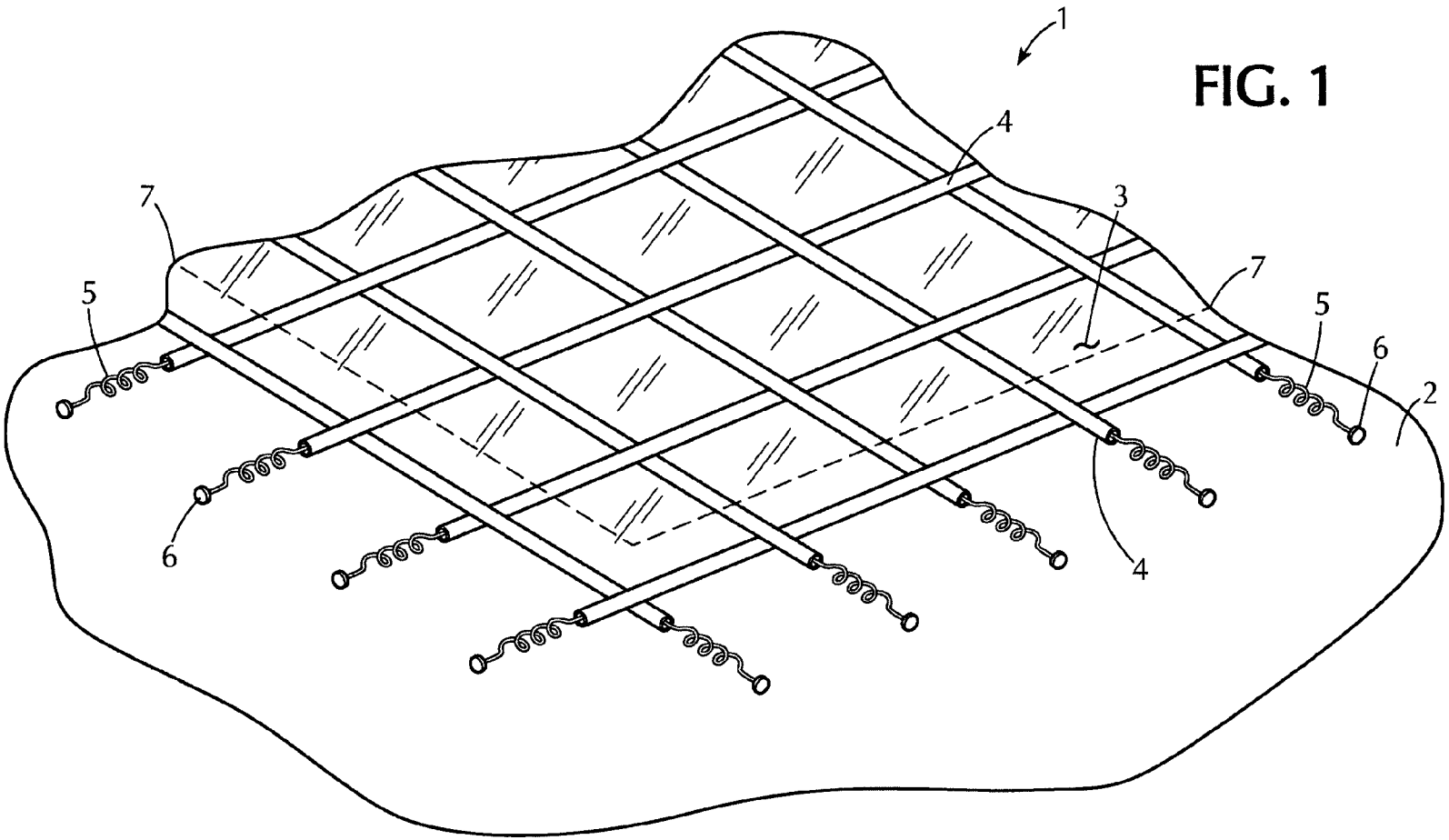
FIG. 1 is a perspective view of a corner of a pool covered by a swimming pool cover in accordance with a preferred embodiment of the present invention.

FIG. 1 shows a corner of a swimming pool cover 1 in use covering a pool 2. The swimming pool cover 1 includes a fabric covering 3 and reinforcing and attachment straps 4. Reinforcing and attachment straps 4 are attached to the fabric covering in a criss-cross pattern; they preferably extend beyond the periphery of fabric covering 3 to serve as attachment straps for retaining springs 5 which are secured to deck 2 using recessed anchors 6. One of ordinary skill in the art would understand alternative means for securing the swimming pool cover 1 to the pool 2. The pool edge is denoted by dashed lines 7.

Figure 2:
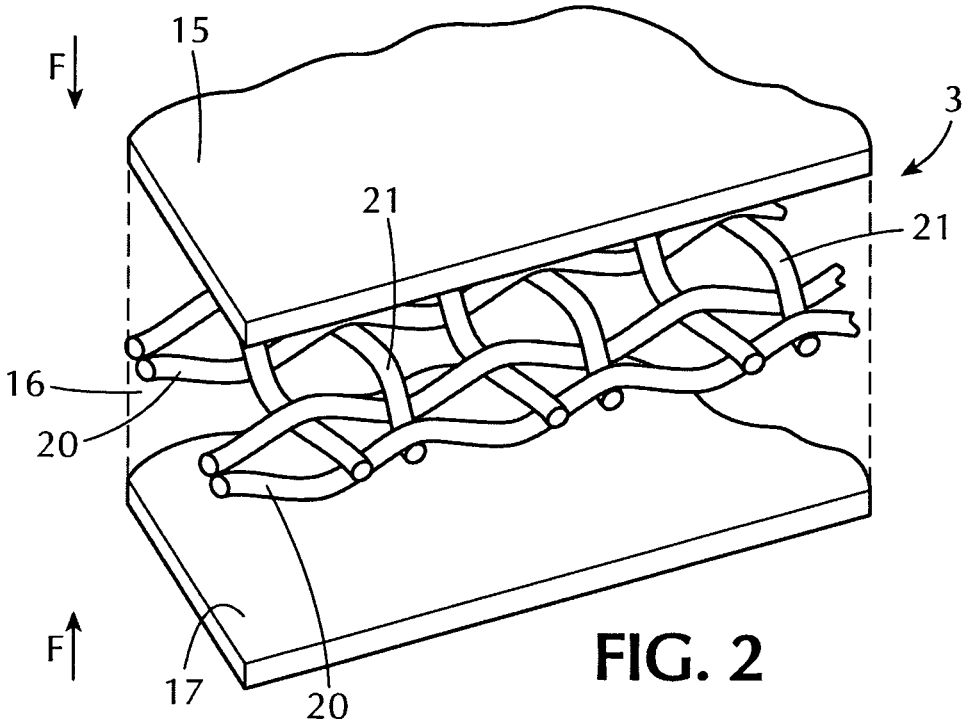
FIG. 2 is an exploded perspective view of the three layers which are used to fabricate the fabric covering used in accordance with a preferred embodiment of the present invention.
Figure 3:
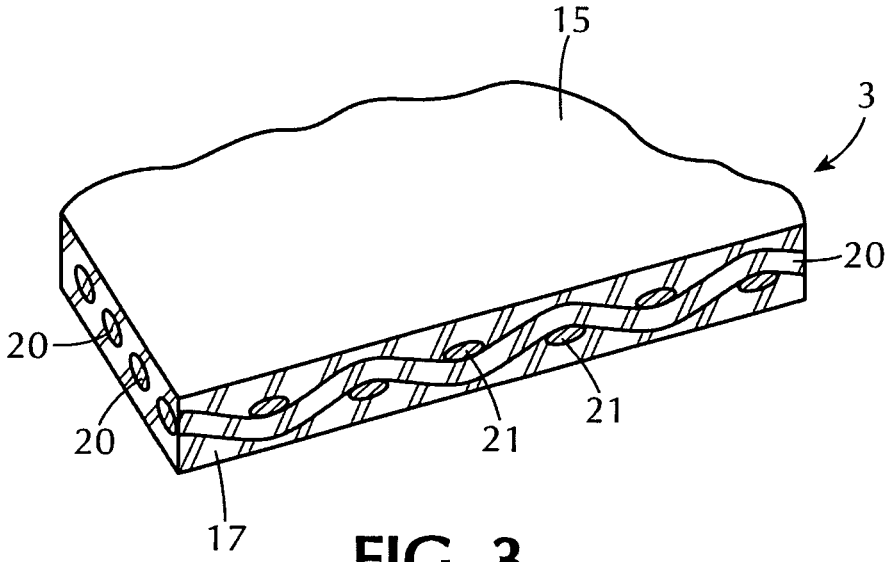
FIG. 3 is a perspective view of the layers of FIG. 2 after they have been subjected to heat and pressure to form a strong resulting fabric covering.

FIGS. 2 and 3 show details of the construction of fabric covering 3. In a preferred embodiment, three layers are used including a top solid layer 15, intermediate multi-filament mesh layer 16 with weft strands 20 and warp strands 21, and bottom solid layer 17. After heat and pressure is applied to the top layer 15 and bottom layer 17 (F directions) the crossection is transformed into a dense fabric totally encasing the intermediate multi-filament mesh 16 as shown. Top and bottom layers, 15 and 17, totally bond together and become indistinguishable, while the strands of the intermediate multi-filament mesh layer 16 remain identifiable lending their strength and tear resistance (rip-stop). Note that only heat and pressure, no foreign adhesives, are used; all elements of the three layers are entirely made of polypropylene. After the pool covers service life period, it may be de-constructed. The polypropylene components may be cleaned and granulated. Granulating machinery produces granules which can then be used in injection molding of polypropylene products.

In one embodiment of the present invention, the fabric covering 3 is a polypropylene, such as, in one example, known in the trade as Greentex™ material supplied by Fabinno Company. The fabric covering 3 is significantly stronger than that of the currently used PVC pool covers, is approximately 10% lighter (oz./sq. yd.), has lower cost, and has a soft hand feel similar to polyvinyl chloride (PVC) fabric. While the strength and the lightness enhance the service life aspects, the fabric covering material is totally polypropylene, which means that it is entirely plasticizer free and completely and easily recyclable, thereby enhancing the final product life-cycle stage.

Performance testing of the fabric material used in this invention yielded the following results: (Ultra-Loc®, having a polypropylene mesh base layer with a low density polyethylene layer on the lower side of the mesh, is the prior art fabric while Ultra-Loc II™ is the fabric of this invention. Ultra-Loc® and Ultra-Loc II™ are trademarks of Applicant's assignee Pool Cover Corporation.)

Tensile strength: Ultra-Loc®: 387×283 (warp×fill)
Ultra-Loc II™: 530×475, an increase of 37%×68%
Tear Strength: Ultra-Loc®: 76×56
Ultra-Loc II: 117×123, an increase of 54%×120%
Puncture Strength: Ultra-Loc®: 185 lbs.
Ultra-Loc II™: 224 lbs., an increase of 21%
Sewn Seam Strength: Ultra-Loc®: 100 lbs. (material failed)
Ultra-Loc II™: 219 lbs. (thread failed)

Other factors relating to the use of the Ultra-Loc II™ polypropylene fabric material also enhance life cycle of the swimming pool cover. The lower pool cover weight saves transport fuel and carbon based emissions. The lower weight and improved hand feel also makes the cover easier to handle to install and remove. The polypropylene fabric material has more "bounce" and faster recovery which elevates pockets; this makes it easier to shed any water that had accumulated. Ultra-Loc II™ is virtually opaque blocking sunlight which sunlight tends to support the formation of algae. Therefore algae growth in the swimming pool water is inhibited.

The swimming pool cover 1 in accordance with the present invention has a "rebound" effect when the polypropylene material is temporarily depressed by puddles of water, which, when evaporated, allows the polypropylene-based swimming pool cover to rebound back to its original shape without a bulge. This "rebound" feature will minimize the maintenance required for the swimming pool cover.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A swimming pool cover in combination with a swimming pool, consisting essentially of:

a) a fabric cover enclosing the swimming pool thereunder; said fabric cover consisting of:

i) a top layer of solid plastic polypropylene material as the only polymer present in said top layer, where a copolymer of polypropylene is absent from said top layer;

ii) an intermediate layer of multi-filament mesh consisting of only polypropylene threads where a copolymer of polypropylene is absent from said intermediate layer of multi-filament mesh; said intermediate layer of mesh being coated with said top layer of solid plastic polypropylene material which penetrates said mesh and seals openings in said mesh; and iii) a bottom layer of solid plastic polypropylene material as the only polymer present in said bottom layer, wherein said bottom layer is attached to said intermediate layer of mesh; where a copolymer of polypropylene is absent from said bottom layer of solid plastic polypropylene material; said intermediate layer of mesh being coated with said bottom layer of solid plastic polypropylene material which penetrates said mesh and seals openings in said mesh;

wherein said top layer and said bottom layer are bonded together and become indistinguishable; and b) reinforcing said swimming pool cover with attachment straps in a cross-crossed pattern on an outer surface of said top layer.

2. The swimming pool cover of claim 1 in which said polypropylene threads are extruded strands of polypropylene.

3. The swimming pool cover of claim 1, wherein said polypropylene does not emit any dioxins when incinerated.

4. The swimming pool cover of claim 1, wherein plasticizers are absent from said polypropylene.

* * * * *